US011834771B2

(12) United States Patent
Kim et al.

(10) Patent No.: US 11,834,771 B2
(45) Date of Patent: Dec. 5, 2023

(54) WASHING MACHINE

(71) Applicant: LG Electronics Inc., Seoul (KR)

(72) Inventors: Hyundong Kim, Seoul (KR); Sooyoung Oh, Seoul (KR); Kyosoon Chae, Seoul (KR); Jinho Kim, Seoul (KR); Heeyeon Kim, Seoul (KR); Hyemin Kim, Seoul (KR); Seungwoo Park, Seoul (KR)

(73) Assignee: LG Electronics Inc., Seoul (KR)

( * ) Notice: Subject to any disclaimer, the term of this patent is extended or adjusted under 35 U.S.C. 154(b) by 255 days.

(21) Appl. No.: 17/294,297

(22) PCT Filed: Nov. 15, 2019

(86) PCT No.: PCT/KR2019/015625
§ 371 (c)(1),
(2) Date: May 14, 2021

(87) PCT Pub. No.: WO2020/101419
PCT Pub. Date: May 22, 2020

(65) Prior Publication Data

US 2022/0010474 A1 Jan. 13, 2022

(30) Foreign Application Priority Data

Nov. 15, 2018 (KR) ..... 10-2018-0140637

(51) Int. Cl.
*D06F 39/02* (2006.01)
*D06F 34/14* (2020.01)
(Continued)

(52) U.S. Cl.
CPC ..... *D06F 39/022* (2013.01); *D06F 23/025* (2013.01); *D06F 34/14* (2020.02); *D06F 39/12* (2013.01)

(58) Field of Classification Search
CPC ..... D06F 39/02; D06F 39/022; D06F 39/028; D06F 39/086; D06F 34/14; D06F 23/025;
(Continued)

(56) References Cited

U.S. PATENT DOCUMENTS 8,943,858 B2 * 2/2015 Burgess ..... D06F 39/022 68/17 R
2012/0096901 A1 4/2012 Zattin et al.
(Continued)

FOREIGN PATENT DOCUMENTS

CN 106884284 6/2017
EP 3348700 7/2018
(Continued)

OTHER PUBLICATIONS

PCT International Application in International Appln. No. PCT/KR2019/015625, dated Nov. 15, 2019, 69 pages (with English translation).
(Continued)

*Primary Examiner* — David G Cormier
(74) *Attorney, Agent, or Firm* — Fish & Richardson P.C.

(57) ABSTRACT

A washing machine includes a cabinet, a tub, a drum, a drawer disposed within the cabinet to hold detergent, a drawer housing configured to insert into and withdraw from the cabinet, a water supply guide flow channel for supplying water passed through the drawer into the tub, a top cover housing covering an open top of the cabinet and defining a receiving space above the cabinet, a detergent mixer disposed in the receiving space, and a discharge guiding mechanism. The detergent mixer includes additive cartridges that accommodate liquid additives, additive pumps corresponding to the additive cartridges, and a flow channel box including pump intake paths that guide the additives from the additive cartridges to the additive pumps and pump
(Continued)

discharge paths that guide the additives discharged from the additive pumps. The discharge guiding mechanism guides the additives discharged from the pump discharge paths to the water supply guide flow channel.

15 Claims, 14 Drawing Sheets

(51) Int. Cl.
*D06F 23/02* (2006.01)
*D06F 39/12* (2006.01)

(58) Field of Classification Search
CPC ..... D06F 33/37; D06F 33/57; D06F 39/12; D06F 2105/42
See application file for complete search history.

(56) References Cited

U.S. PATENT DOCUMENTS

| | | | |
|---|---|---|---|
| 2014/0041418 | A1 | 2/2014 | Lee et al. |
| 2016/0273150 | A1 | 9/2016 | Del Pos et al. |

FOREIGN PATENT DOCUMENTS

| | | |
|---|---|---|
| JP | 2017080229 | 5/2017 |
| JP | 2017127339 | 7/2017 |
| KR | 20180080013 | 7/2018 |
| WO | WO2020101419 | 5/2020 |

OTHER PUBLICATIONS

International Search Report in International Appln. No. PCT/KR2019/015625, dated Mar. 10, 2022, 5 pages (with English translation).
Office Action in Australian Appln. No. 2019378536, dated Jul. 11, 2022, 5 pages.

* cited by examiner

WASHING MACHINE

CROSS-REFERENCE TO RELATED APPLICATIONS

This application is a National Stage application under 35 U.S.C. § 371 of International Application No. PCT/KR2019/015625, filed on Nov. 15, 2019, which claims the benefit of Korean Patent Application No. 10-2018-0140637, filed on Nov. 15, 2018. The disclosures of the prior applications are incorporated by reference in their entirety.

BACKGROUND OF THE DISCLOSURE

Field of the Disclosure

The present disclosure relates to a washing machine, and more particularly, to a washing machine into which different types of additives can be mixed and put.

Related Art

A washing machine is a device that treats laundry through various operations including a washing operation, a dewatering operation and/or a drying operation. The washing machine is a device that removes contaminants from laundry (hereinafter, also referred to as "fabrics") using water and detergent.

Korean Patent Laid-Open Publication No. 10-2013-0062272 (hereinafter, "272 patent") discloses a dispensing system inside a washing machine, which is capable of releasing prepared products. The dispensing system includes a cartridge consisting of three or more chambers holding different prepared liquid products, and a dispenser detachably attached to the cartridge. Prepared products coming out from the dispenser join a dispensing drawer on the front of the main body of the washing machine via a fluid line.

Since the cartridge and the dispenser are disposed on a top surface of the main body of the washing machine, the dispensing drawer needs to be protruded forward from the front of the main body and the end of the fluid line needs to be connected to the protruded portion of the dispensing drawer from above, in order for the fluid line extended from the dispenser to join the dispensing drawer. Such a structure will spoil the overall aesthetic appearance of the washing machine, and at the same time, it has been difficult to adapt this dispensing system to conventional washing machine products, because the dispensing drawer's structure is different from those of conventionally used ones. Besides, the fluid line moves jerkily as well when the dispensing drawer is pushed in or pulled out, and this has adverse effects on the durability of the product.

SUMMARY

A first aspect of the present disclosure is to provide a washing machine that has a detergent mixer within a top cover housing that covers an open top of a cabinet.

A second aspect of the present disclosure is to provide a washing machine that has a plurality of additive cartridges within the top cover housing.

A third aspect of the present disclosure is to provide a washing machine that improves the construction of flow channels for guiding liquid additives discharged from the additive cartridges, thus facilitating the installation of the flow channels.

A fourth aspect of the present disclosure is to provide a washing machine in which the flow channels are connected to a drawer housing disposed within a cabinet.

A fifth aspect of the present disclosure is to provide a washing machine that has additive pumps to force out the additives discharged from the additive cartridges.

The aspects of the present disclosure are not limited to the aforementioned aspects, and other aspects, which are not mentioned above, will be apparent to a person having ordinary skill in the art from the following description.

A washing machine according to the present disclosure includes a detergent mixer that mixes and supplies liquid additives. The detergent mixer may be disposed above a cabinet that forms a space where a tub and a drum are received. The top of the cabinet may be open, and the open top of the cabinet may be covered by a top cover housing. A predetermined receiving space may be defined by the top cover housing, and the detergent mixer may be disposed within the receiving space.

A drawer housing may be disposed inside the cabinet, where the drawer is received in such a way as to be pulled out, and which has a water supply guide flow channel for allowing water passed through the drawer to be poured into the tub when water is supplied.

The detergent mixer may include: a plurality of additive cartridges that individually contain liquid additives; and a plurality of additive pumps corresponding to the plurality of additive cartridges.

A flow channel box may be provided to guide the additives discharged from the additive pumps. The flow channel box may include: a plurality of pump intake paths that guide the additives discharged from the additive cartridges to the additive pumps, respectively; and a plurality of pump discharge paths that guide the additives discharged from the additive pumps, respectively. The discharge guiding mechanism may guide the additives discharged from the pump discharge paths to the water supply guide flow channel.

Details of other embodiments will be included in the detailed description of the disclosure and the accompanying drawings.

A first advantage of a washing machine according to the present disclosure is that a detergent mixer is disposed within a top cover housing that covers an open top of a cabinet, thereby preventing the detergent mixer from being externally exposed.

A second advantage is that the detergent mixer can be readily adapted to conventional products by replacing the top cover (which is configured to cover the open top of the cabinet) of a conventional washing machine by the top cover housing where the detergent mixer is assembled.

A third advantage is that the washing machine can maintain the same appearance by disposing a plurality of additive cartridges within the top cover housing, because, even when some of the additive cartridges are not in use, with no additives in them, their empty space is concealed by the top cover housing.

A fourth advantage is that the construction of flow channels for guiding liquid additives discharged from the additive cartridges is improved compared to the conventional art, thus facilitating the installation and maintenance of the flow channels.

A fifth advantage is that it is possible to keep the flow channels from dangling when the drawer is pushed in or pulled out, even if they are made of soft material, since the flow channels are connected to the drawer housing disposed within the cabinet.

A sixth advantage is that additives can be released quickly and quantitatively since the additives discharged from the additive cartridges are forced out by the additive pumps.

The effects of the present disclosure are not limited to the effects mentioned above, and other effects not mentioned can be clearly understood by those skilled in the art from the description of the claims.

Figure 10:
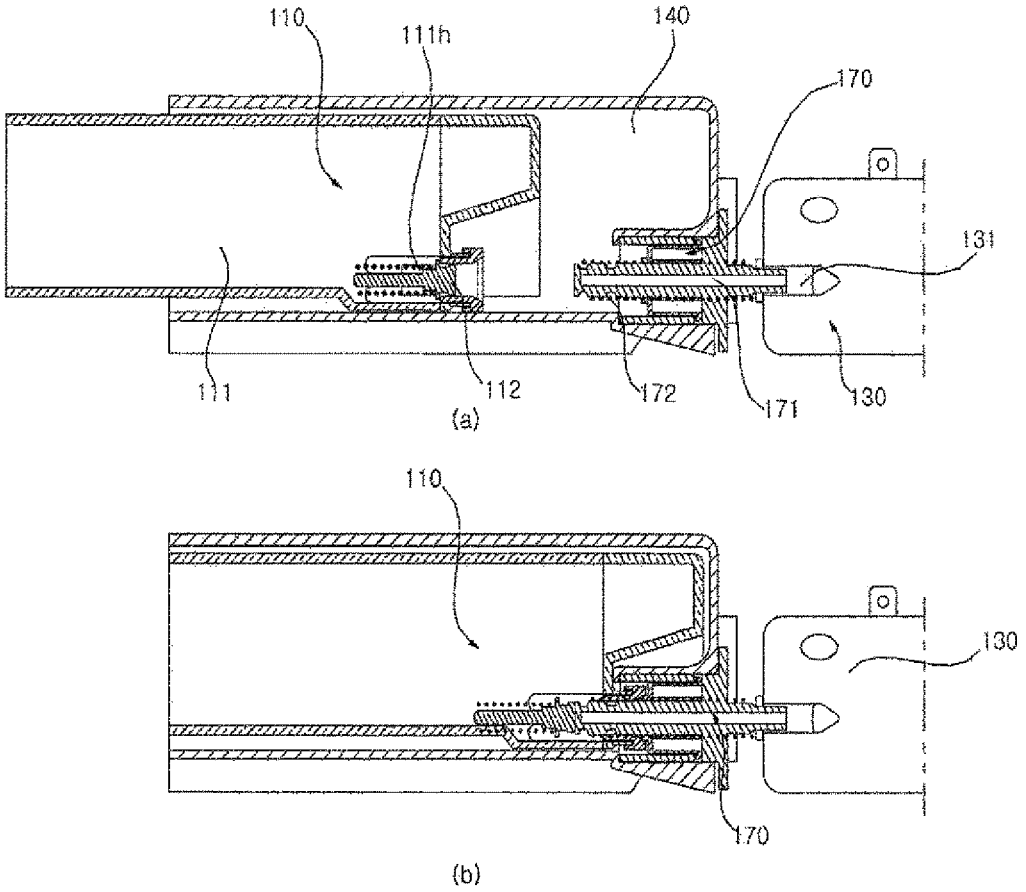

(a) of FIG. 10 depicts a process in which a cartridge is inserted into a cartridge housing, and (b) of FIG. 10 depicts a cartridge valve being opened by a cartridge.

Figure 11:
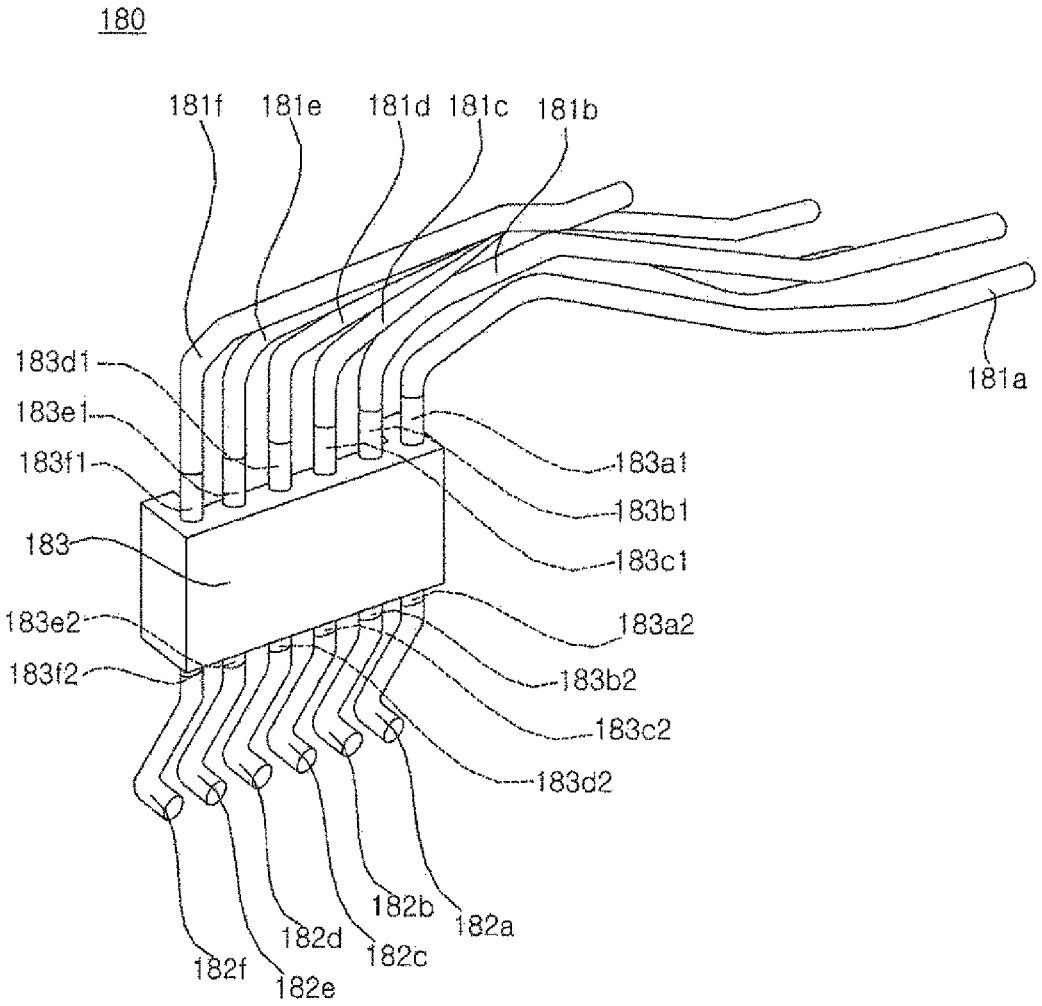

FIG. 11 is a perspective view of the flow channel connector.

Figure 12:
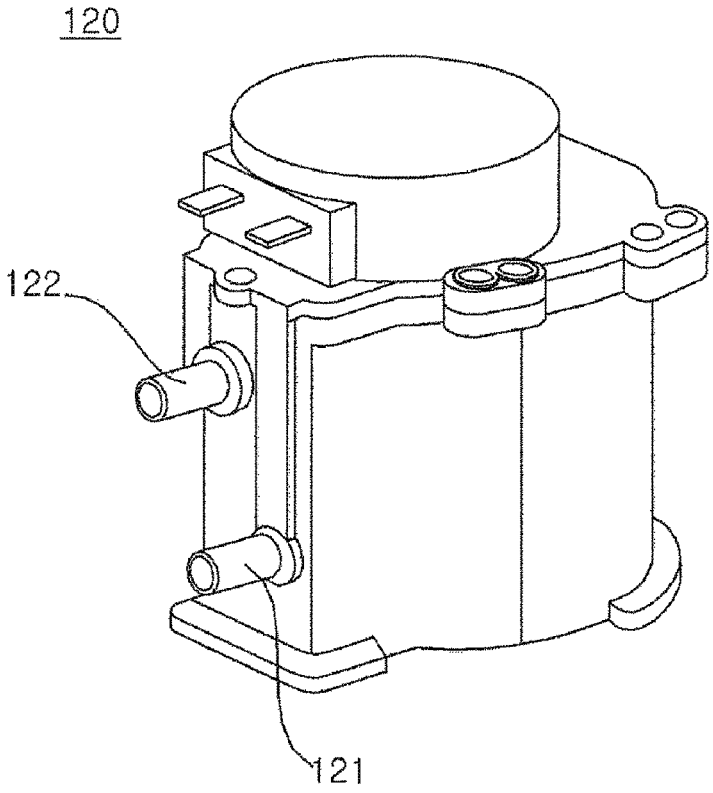

FIG. 12 is a perspective view of an additive pump.

Figure 13:
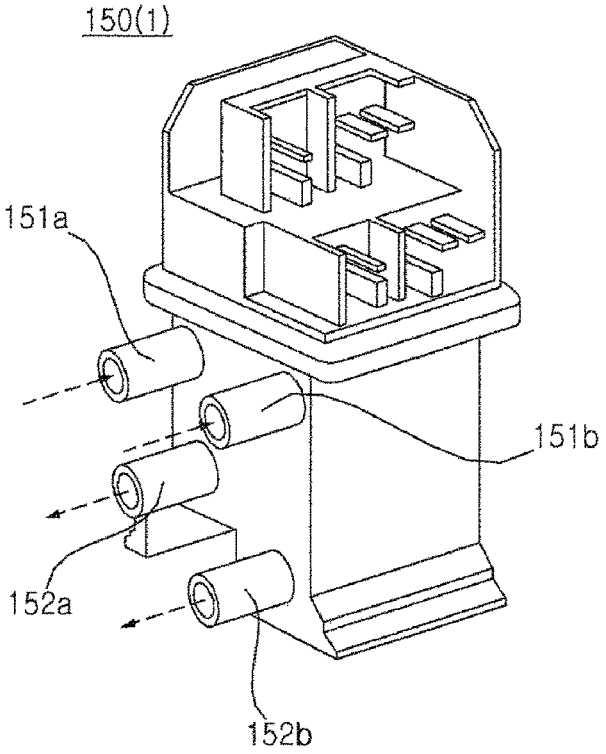

FIG. 13 is a perspective view of an electrode sensor module.

Figure 6:
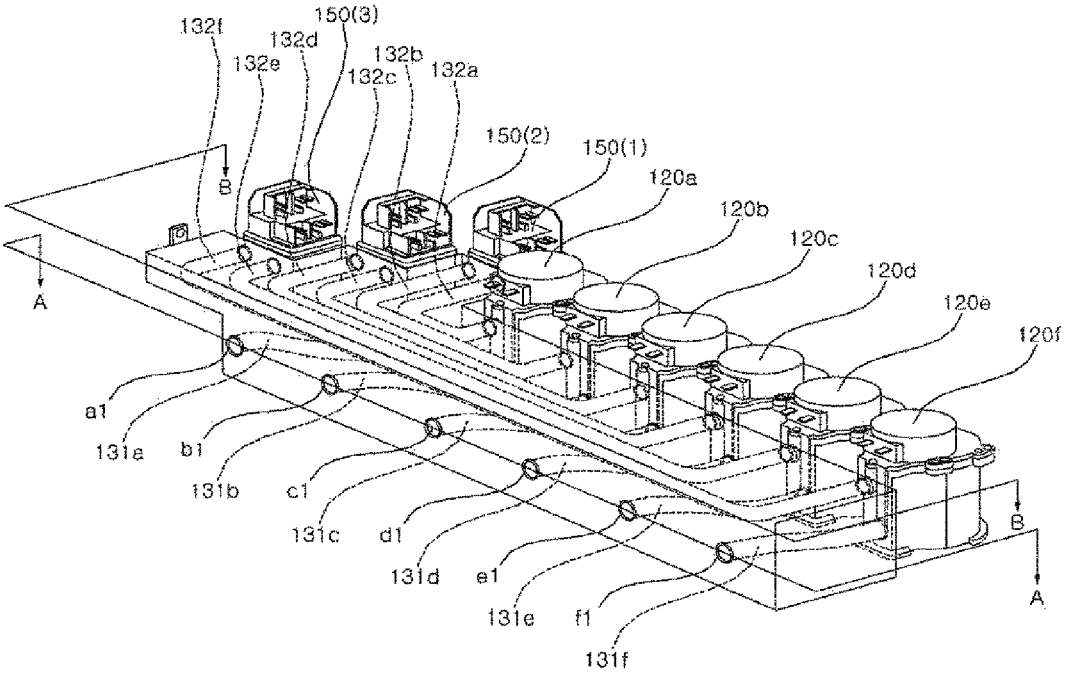
Figure 14:
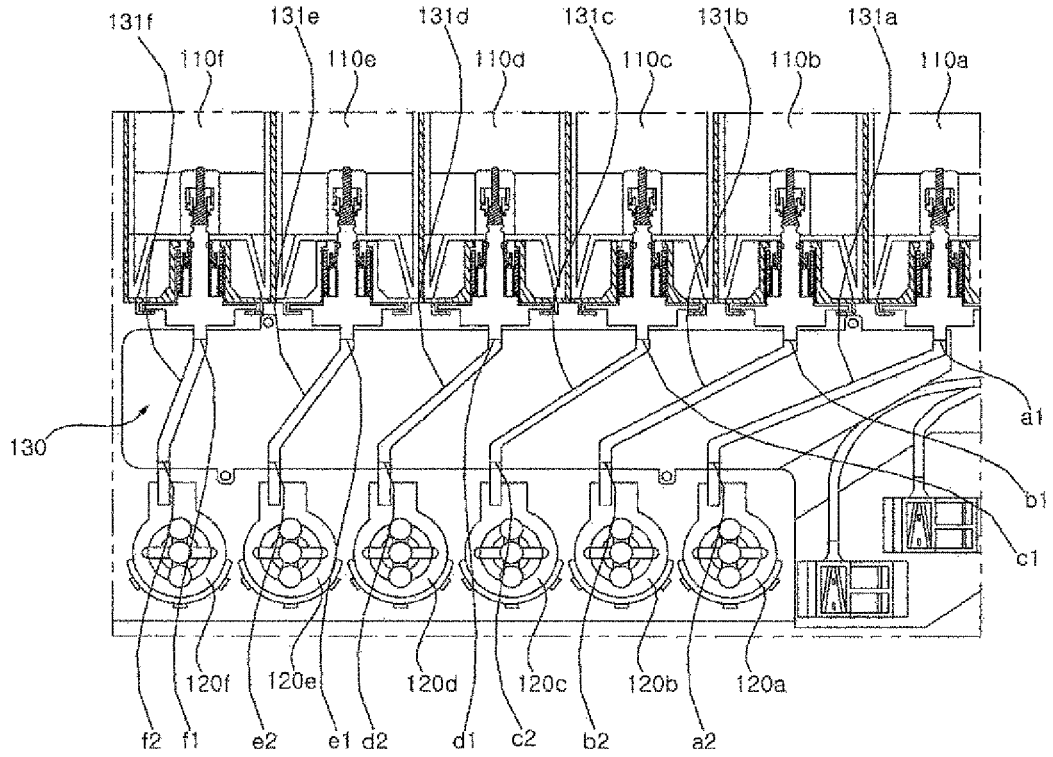

FIG. 14 is a cross-sectional view of a flow channel box taken along the line A-A of FIG. 6.

Figure 15:
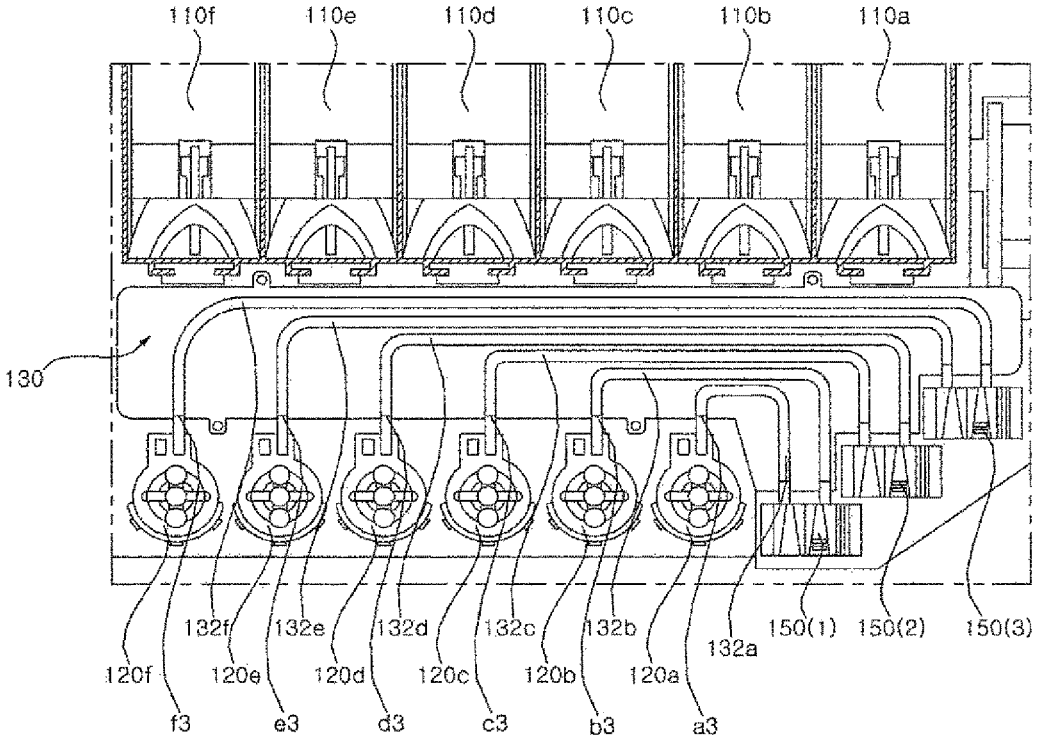

FIG. 15 is a cross-sectional view of the flow channel box taken along the line B-A of FIG. 6.

DESCRIPTION OF EXEMPLARY EMBODIMENTS

The advantages and features of the present disclosure and the methods for achieving them will hereinafter be made clear with reference to embodiments described below in detail with reference to the accompanying drawings. However, it should be understood that the present disclosure is not limited to the embodiments disclosed herein but may be embodied in other various forms. The present embodiments are provided so that this disclosure will be thorough and complete and will fully convey the scope of the invention to those skilled in the art to which the present disclosure pertains. The present disclosure is defined only by the scope of the claims. Like reference numerals refer to like elements throughout the specification.

Figure 1:
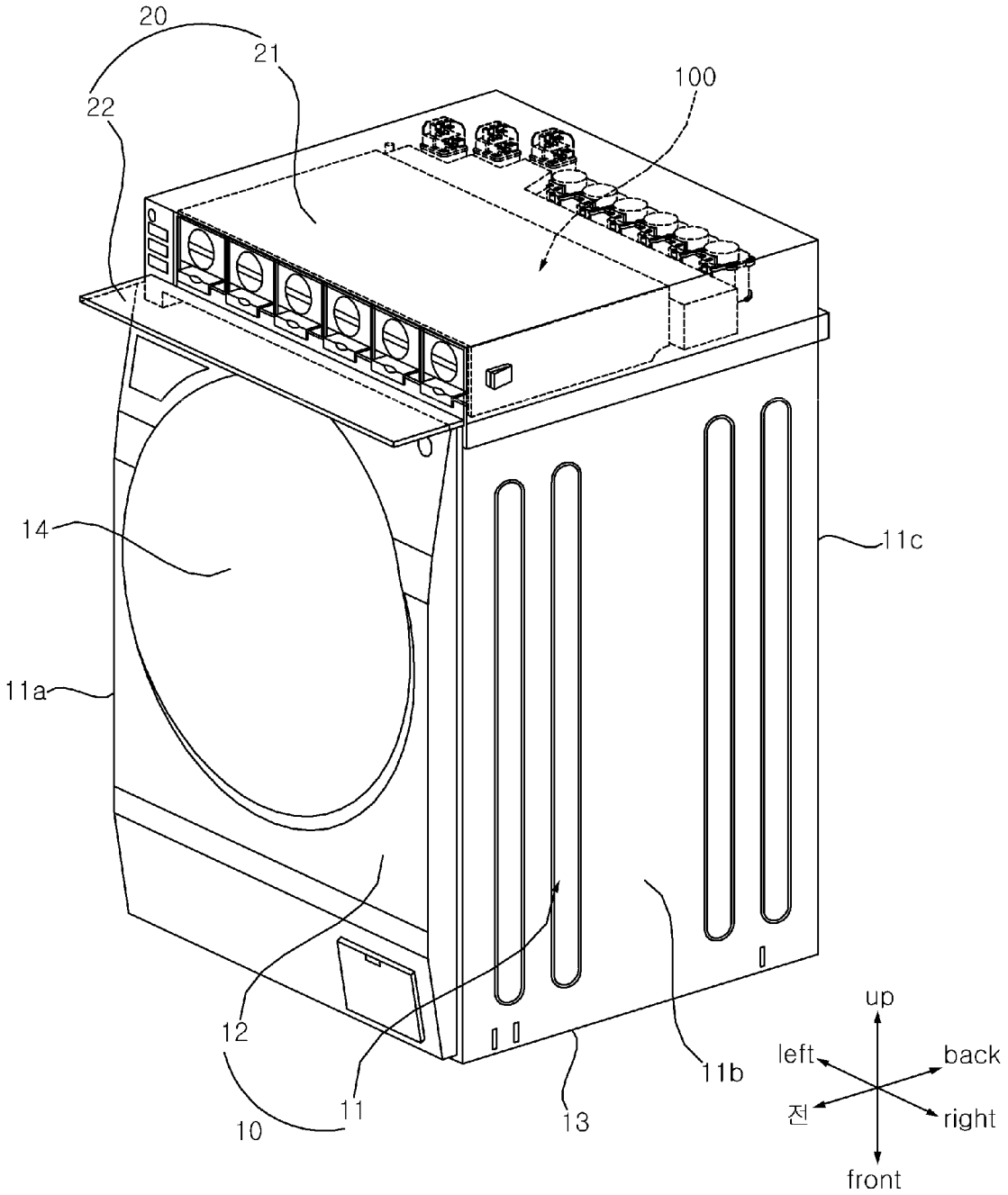
FIG. 1 is a perspective view of a washing machine according to an exemplary embodiment of the present disclosure.
Figure 2:
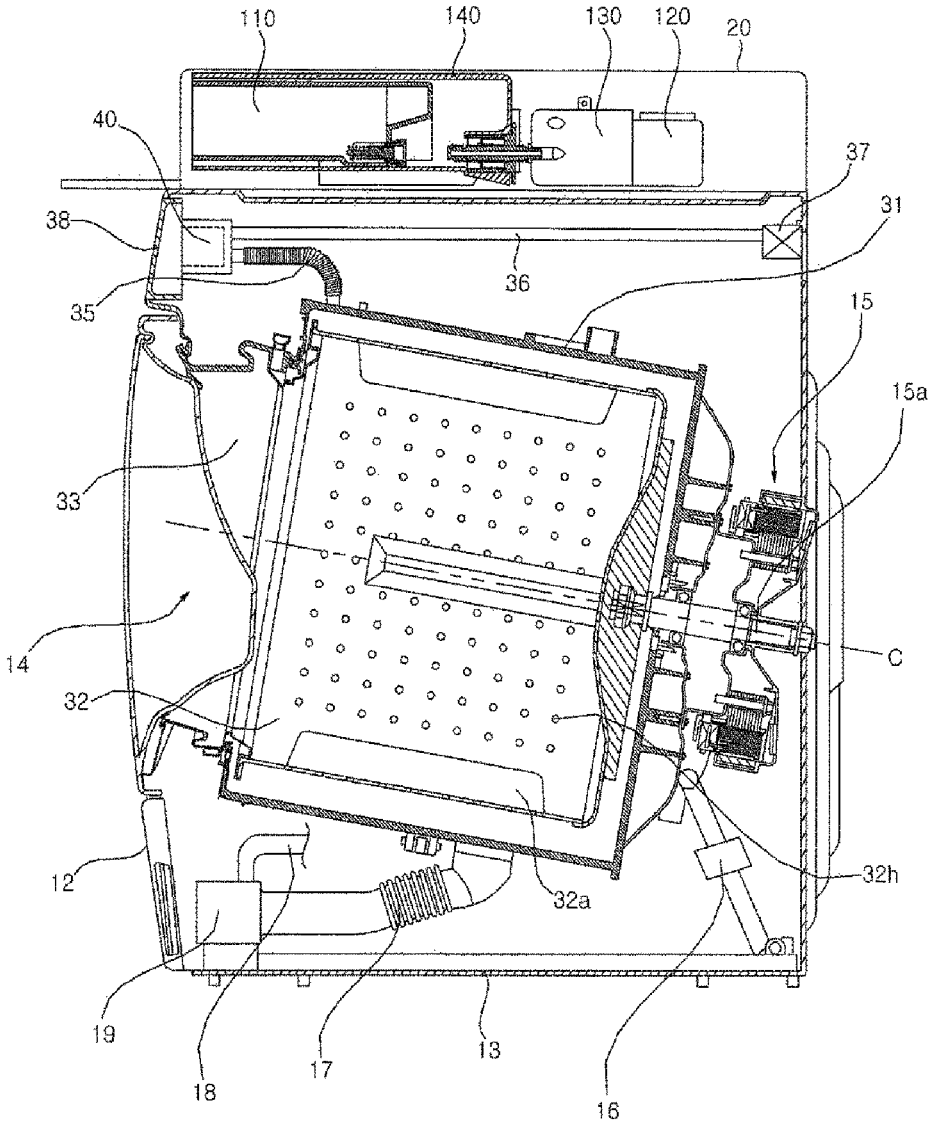
FIG. 2 is a view showing internal components of the washing machine.
Figure 3:
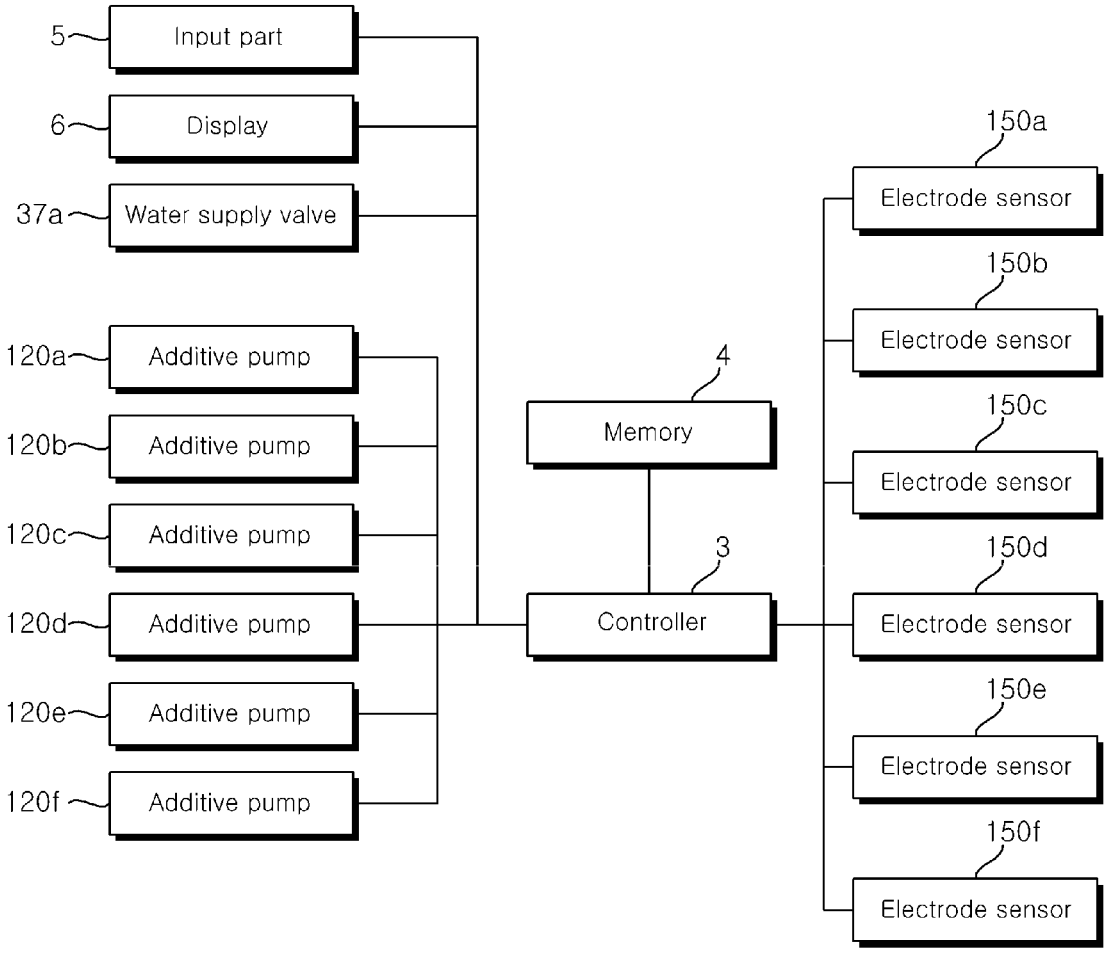
FIG. 3 is a sequence chart showing the control relationship between main components of the washing machine.

FIG. 1 is a perspective view of a washing machine according to an exemplary embodiment of the present disclosure. FIG. 2 is a view showing internal components of the washing machine. FIG. 3 is a sequence chart showing the control relationship between main components of the washing machine.

Referring to FIGS. 1 to 3, a washing machine according to an exemplary embodiment of the present disclosure includes a cabinet 10 with an open top and a top cover housing 20 that covers the open top of the cabinet 10.

The cabinet 10 forms the outward appearance of the washing machine, and provides a predetermined space inside where a tub 31, a drum 32, etc. are received. The cabinet 10 may include a main frame 11, whose front is open, and which has a left side 11*a*, a right side 11*b*, and a back side 11*c*, a front panel 12 that has a loading opening and is attached to the open front of the main frame 11, and a level base 13 that supports the main frame 11 and the front panel 12 from below. A door 14 for opening and closing the loading opening may be rotatably attached to the front panel 12.

Referring to FIG. 2, a cylindrical tub 31 for containing water, with an open front and a closed back, may be disposed within the cabinet 10. The front panel 12 and the tub 31 are connected by a ring gasket 33, thereby forming a passage for allowing laundry to enter or leave therethrough, in an area running from the open inlet on the front of the tub 31 to the loading opening of the front panel 12.

The gasket 33 has a tubular shape whose front and back ends are ring-shaped, and which extends from the front end to the back end. The front end of the gasket 33 is fixed to the front panel 12, and the back end thereof is fixed to the perimeter of the inlet of the tub 31. The gasket 33 may be made of a flexible or elastic material. The front end of the gasket 33 is tightly attached to the rear of the door 14 while the door 14 is closed, thereby preventing the water in the tub 31 from leaking through the inlet of the gasket 33.

The drum 32 may be rotatably provided in the tub 31. The drum 32 is where laundry is received, which has an inlet on the front through which laundry is loaded and rotates around an approximately horizontal axis C. Here, the term "horizontal" is not used in a mathematically strict sense. That is, even if the axis C is tilted at a predetermined angle to the horizontal, as in the exemplary embodiment, the axis can be considered substantially horizontal as long as it is more horizontal than vertical. The drum 32 has a plurality of through holes 32*h* so that the water in the tub 32 is admitted into the drum 32 through them.

A plurality of lifters 32*a* may be provided on the inner side of the drum 32. The plurality of lifters 32*a* may be positioned at a given angle to the center of the drum 32. When the drum 32 rotates, the laundry is repetitively lifted and dropped by the lifters 32*a*.

A driver 15 is provided to rotate the drum 32. A driving shaft 15*a*, which is rotated by the driver 15, may be attached to the drum 32 through a rear portion of the tub 31.

Preferably, the driver 15 includes a direct-coupled washing motor, and the washing motor may include a stator fixed to the rear of the tub 31 and a rotor that rotates by a magnetic force acting between the stator and the rotor. The driving shaft 15*a* may rotate in unison with the rotor.

The tub 31 may be supported by a damper 16 mounted on the base 13. Vibration of the tub 31 caused by the rotation of the drum 32 is reduced by the damper 16. Although not illustrated, a hanger (e.g., spring) for hanging the tub 31 in a casing 10 may be added depending on the embodiment.

At least one water supply hose (not shown) may be provided to guide water supplied from an external source of water such as a water faucet, and a water supply part 37 may be provided to control the supply of water to a water supply pipe 36 through the at least one water supply hose. The water supply part 37 may include at least one water supply valve 37*a* for regulating the water supply pipe 36.

The cabinet 10 may have a drawer 38 that holds detergent and a drawer housing 40 where the drawer 38 is received in such a way as to be pulled out. The detergent may also include bleach and fabric softener, as well as laundry detergent. The drawer housing 40 may have a water supply guide flow channel 41 (see FIG. 9) for guiding water passed through the drawer 38 to be poured into the tub 31 when water is supplied through the water supply pipe 36.

Figure 9:
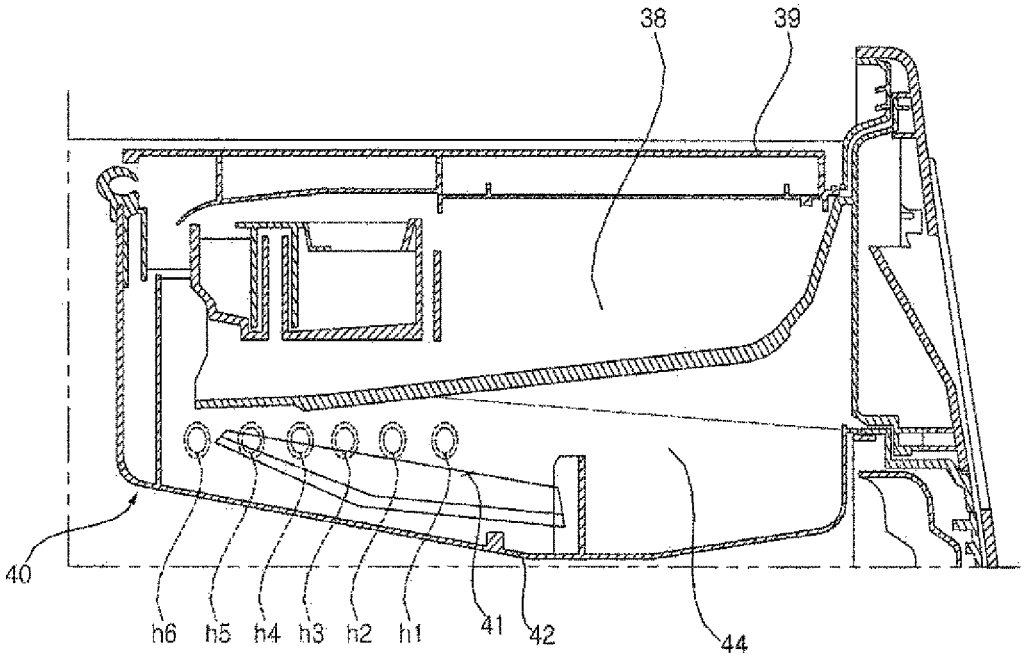
FIG. 9 depicts cross-sections of a dispenser, a drawer, and a drawer housing.

The drawer 38 may have sectioned receptacles for holding detergent such as the laundry detergent, fabric softener, or bleach. Referring to FIG. 9, a water supply dispenser 39 may be provided to release the water supplied through the water supply pipe 36 to the drawer 38. The water supply dispenser 39 may distribute water to the receptacles of the drawer 38. A plurality of water supply pipes 36 may be provided to selectively guide water to the flow channels of the water supply dispenser 39 (the flow channels may be configured to supply water to the respective receptacles of the drawer 38). In this case, a plurality of water supply valves may be provided to selectively regulate the plurality of water supply pipes 36.

The water coming out from the drawer housing 40 is supplied to the tub 31 through a water supply bellows 35 (see FIG. 2). A water supply inlet (not shown) connected to the bellow 35 may be formed on a side of the tub 31.

A drain outlet may be formed on the tub 31 to drain water out, and a drain bellows 17 may be connected to the drain outlet. Also, a drain pump 19 may be provided to pump the water coming out from the tub 31 through the drain bellows 17. The water forced out by the drain pump 19 is expelled from the washing machine through a drain hose 18.

Meanwhile, the top cover housing 20 may be provided to cover the open top of the cabinet 10 and define a predetermined receiving space above the cabinet 10.

The top cover housing 20 may include a housing body 21 with an inlet on the front, inside which the receiving space is defined, and a housing cover 22 for opening and closing the inlet.

The housing body 21 has a rectangular shape with an open front, and may include a lower plate 211, an upper plate 212, a left plate 213, a right plate 214, and a back plate 215 which define the respective sides of the rectangle.

A detergent mixer 100 is disposed in the receiving space of the top cover housing 20. The detergent mixer 100 includes a plurality of additive cartridges 110 (110*a*, 110*b*, 110*c*, 110*d*, 110*e*, and 1100, a plurality of additive pumps 120 (120*a*, 120*b*, 120*c*, 120*d*, 120*e*, and 1200, and a flow channel box 130, all of which may be disposed on the lower plate 211.

Liquid detergent is contained in the additive cartridges 110*a*, 110*b*, 110*c*, 110*d*, 110*e*, and 110*f*; preferably, additives of different compositions are contained in the respective additive cartridges 110*a*, 110*b*, 110*c*, 110*d*, 110*e*, and 110*f*. Although preferably two or more additive cartridges 110*a*, 110*b*, 110*c*, 110*d*, 110*e*, and 110*f*—six in the exemplary embodiment, are provided, the number of additive cartridges is not limited by the above values.

Figure 4:
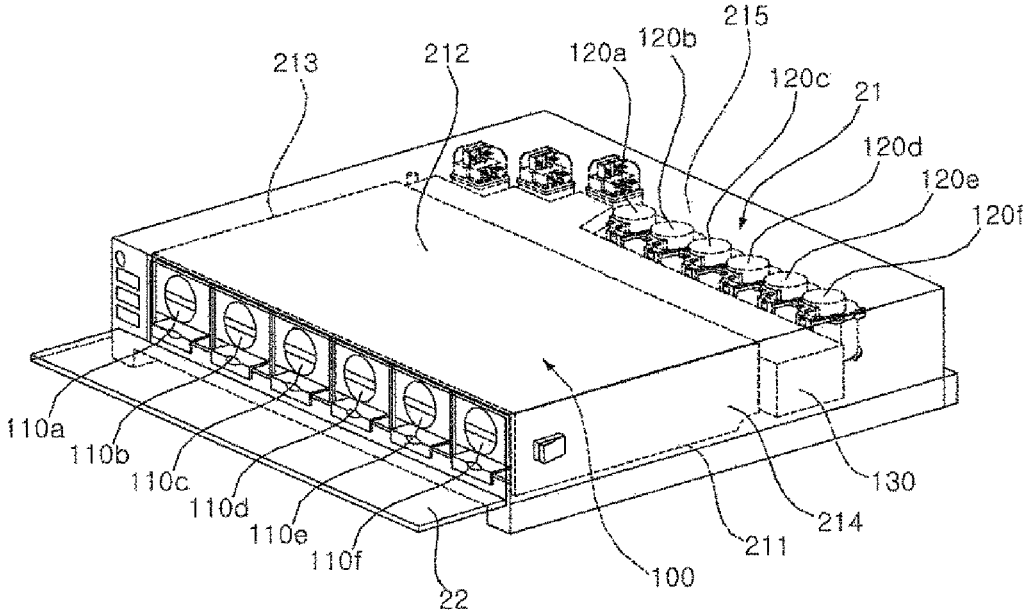
FIG. 4 depicts an assembly of a top cover housing and a detergent mixer.

The additive pumps 120*a*, 120*b*, 120*c*, 120*d*, 120*e*, and 120*f* may be configured to correspond to the additive cartridges 110*a*, 110*b*, 110*c*, 110*d*, 110*e*, and 110*f*, respectively. The additive pumps 120*a*, 120*b*, 120*c*, 120*d*, 120*e*, and 120*f* may be controlled by a controller 3 (see FIG. 3). Detergent information such as the components of a certain detergent, the composition ratio of these components, etc. may be stored in a memory 4 (see FIG. 4). One of these components is contained in each of the additive cartridges 110*a*, 110*b*, 110*c*, 110*d*, 110*e*, and 110*f*, and the controller 3 may control the additive pumps 120*a*, 120*b*, 120*c*, 120*d*, 120*e*, and 120*f* based on the detergent information stored in the memory 4.

The washing machine may further include an input part 5 for receiving from the user various kinds of control commands for the operation of the washing machine. The input part 5 may be provided in an upper portion of the front panel 12. The front panel 12 may also have a display 6 for showing the operating status of the washing machine.

The controller 3 may select the type of detergent from the memory 4 and check the corresponding detergent information according to the settings entered by the user through the input part 5. Also, the controller 3 may control the operations of the additive pumps 120*a*, 120*b*, 120*c*, 120*d*, 120*e*, and 120*f* in order to prepare the selected detergent. That is, according to the additives which the selected detergent is composed of and the composition ratio of the additives, the operations of the additive cartridges 110*a*, 110*b*, 110*c*, 110*d*, 110*e*, and 110*f* containing these additives and the operations of the corresponding additive pumps 120*a*, 120*b*, 120*c*, 120*d*, 120*e*, and 120*f* (such as pump start/stop and operating time) may be controlled.

The top cover housing 20 may be attached to an upper end of the cabinet 10. The top cover housing 20 may be slidably attached to the upper end of the cabinet 10. Preferably, the top cover housing 20 may slide forward or backward.

The left plate 213 and right plate 214 of the housing body 21 may be configured to slide along upper ends of the left side 11*a* and right side 11*b* of the main frame 11. After placing the top cover housing 20 in an appropriate position on the open top of the cabinet 10 and properly moving (sliding) the housing body 21 forward or backward, the top cover housing 20 may be fixed to the main frame 11 with a fastening member such as a screw, a bolt, a hook, etc.

Referring to FIG. 6, the flow channel box 130 includes a plurality of pump intake paths 131*a*, 131*b*, 131*c*, 131*d*, 131*e*, and 131*f* that guide the additives discharged from the additive cartridges 110*a*, 110*b*, 110*c*, 110*d*, 110*e*, and 110*f* to the additive pumps 120*a*, 120*b*, 120*c*, 120*d*, 120*e*, and 120*f*, respectively, and a plurality of pump discharge paths 132*a*, 132*b*, 132*c*, 132*d*, 132*e*, and 132*f* that guide the additives discharged from the additive pumps 120*a*, 120*b*, 120*c*, 120*d*, 120*e*, and 120*f*, respectively. The pump intake paths 131*a*, 131*b*, 131*c*, 131*d*, 131*e*, and 131*f* and the pump discharge paths 132*a*, 132*b*, 132*c*, 132*d*, 132*e*, and 132*f* may be formed integrally with the flow channel box 130.

The pump intake paths 131*a*, 131*b*, 131*c*, 131*d*, 131*e*, and 131*f* are connected to the outlets 111*h* of their corresponding additive cartridges 110*a*, 110*b*, 110*c*, 110*d*, 110*e*, and 110*f* by flow channels. Thus, the additives discharged through the outlets 111*h* of the additive cartridges 110*a*, 110*b*, 110*c*, 110*d*, 110*e*, and 110*f* are admitted to the additive pumps 120*a*, 120*b*, 120*c*, 120*d*, 120*e*, and 120*f* through the pump intake paths 131*a*, 131*b*, 131*c*, 131*d*, 131*e*, and 131*f*.

The outlets 111*h* of the additive cartridges 110*a*, 110*b*, 110*c*, 110*d*, 110*e*, and 110*f* do not always need to be connected directly to the pump intake paths 131*a*, 131*b*, 131*c*, 131*d*, 131*e*, and 131*f*, but instead may be connected to them by means of a cartridge connector 170 (see FIG. 10) as in the exemplary embodiment.

Figure 5:
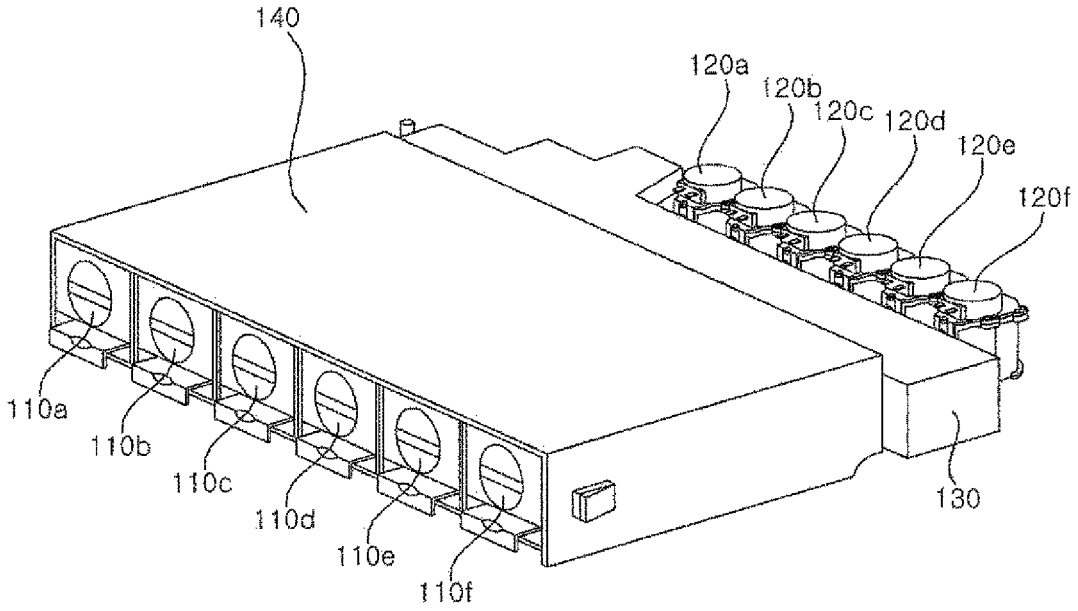
FIGS. 5 and 6 depict the detergent mixer.

Referring to FIG. 5, the detergent mixer 100 may further include a cartridge housing 140. The cartridge housing 140 defines a space inside where the additive cartridges 110*a*, 110*b*, 110*c*, 110*d*, 110*e*, and 110*f* are placed. The cartridge housing 140 may be disposed within the top cover housing 20.

The cartridge housing 140 may be disposed on the lower plate 211 and have a flat rectangular shape with a long cross-section running laterally, with its front (i.e., the side facing the front of the housing body 21) being open. The open front of the cartridge housing 140 communicates with the inlet of the top cover housing 20. Thus, if the user wants to mount, remove, or replace the additive cartridges 110*a*, 110*b*, 110*c*, 110*d*, 110*e*, and 110*f*, they may open the housing cover 22 and then push the additive cartridges 110*a*, 110*b*, 110*c*, 110*d*, 110*e*, and 110*f* into the cartridge housing 140 through the open top of the cartridge housing 140 or pull them out from the cartridge housing 140 through the open top of the cartridge housing 140.

Referring to FIG. 10, the additive cartridges 110 may include a container 111 containing an additive and a check valve 112 for regulating the outlet 111*h* of the container 111. The check valve 112 is opened by the cartridge connector 170 in a process of inserting the additive cartridge 110 into the cartridge housing 140, thereby opening the outlet 111*h*. Once the outlet 111*h* is opened, the additive in the container 111 is discharged through the outlet 111*h*, and the discharged additive joins a predetermined pump intake path 131 through a connecting path 171 formed in the cartridge connector 170.

Meanwhile, referring to FIG. 6, each of the pump intake paths 131*a*, 131*b*, 131*c*, 131*d*, 131*e*, and 131*f* may include a cartridge connecting port a1, b1, c1, d1, e1, and f1 connected by a flow channel to the outlet of one of the additive cartridges 110*a*, 110*b*, 110*c*, 110*d*, 110*e*, and 110*f*, and a pump input end connecting port a2, b2, c2, d2, e2, and f2 (see FIG. 14) connected to an inlet 121 (see FIG. 12) of one of the additive pumps 120*a*, 120*b*, 120*c*, 120*d*, 120*e*, and 120*f*.

Referring to FIG. 15, each of the pump discharge paths 132*a*, 132*b*, 132*c*, 132*d*, 132*e*, and 132*f* may include a pump output end connecting port a3, b3, c3, d3, e3, and f3 connected to an output end 122 (see FIG. 12) of one of the additive pumps 120*a*, 120*b*, 120*c*, 120*d*, 120*e*, and 120*f*.

Although the outlets 111*h* of the additive cartridges 110*a*, 110*b*, 110*c*, 110*d*, 110*e*, and 110*f* and the cartridge connecting ports a1, b1, c1, d1, e1, and f1 may be directly connected together, it is preferable that they are connected together by means of the cartridge connector 170 as in the exemplary embodiment.

Referring to FIG. 10, the check valve 170 may include a valve head 171 and an elastic member 172 that supports the valve head 171. The valve head 171 is configured to move in the direction in which the additive cartridges 110*a*, 110*b*, 110*c*, 110*d*, 110*e*, and 110*f* are pushed in or pulled out. That is, the valve head 171 moves as it is compressed in the opposite direction (forward from the back in the exemplary embodiment) by means of the cartridge connector 170, in the process in which the additive cartridges 110*a*, 110*b*, 110*c*, 110*d*, 110*e*, and 110*f* are inserted into the cartridge housing 140 in a predetermined direction (backward from the front in the exemplary embodiment). The elastic member 172 deforms as the valve head 171 moves, and the deformed elastic member 172 returns to its original shape when the check valve 170 is separated from the cartridge connector 170, which causes the valve head 171 to be pushed and moved backward, thereby closing the outlets 111*h* of the additive cartridges 110*a*, 110*b*, 110*c*, 110*d*, 110*e*, and 110*f*.

The flow channel box 130 may be located between the additive cartridges 110*a*, 110*b*, 110*c*, 110*d*, 110*e*, and 110*f* and the additive pumps 120*a*, 120*b*, 120*c*, 120*d*, 120*e*, and 120*f* That is, the additive cartridges 110*a*, 110*b*, 110*c*, 110*d*, 110*e*, and 110*f* may be arranged laterally, the flow channel box 130 may be disposed behind the additive cartridges 110*a*, 110*b*, 110*c*, 110*d*, 110*e*, and 110*f*, and the additive pumps 120*a*, 120*b*, 120*c*, 120*d*, 120*e*, and 120*f* may be arranged laterally behind the flow channel box 130.

The cartridge connecting ports a1, b1, c1, d1, e1, and f1, the pump input end connecting ports a2, b2, c2, d2, e2, and f2, and the pump output end connecting ports a3, b3, c3, d3, e3, and f3 may be provided on an outer surface of the flow channel box 130.

The cartridge connecting ports a1, b1, c1, d1, e1, and f1 may be provided on the front of the flow channel box 130 (i.e., on the side facing the additive cartridges 110*a*, 110*b*, 110*c*, 110*d*, 110*e*, and 1100. The cartridge connecting ports a1, b1, c1, d1, e1, and f1 may be arranged laterally, preferably, horizontally at the same height.

The pump input end connecting ports a2, b2, c2, d2, e2, and f2 and the pump output end connecting ports a3, b3, c3, d3, e3, and f3 may be provided on the back side of the flow channel box 130 (i.e., on the side facing the additive pumps 120*a*, 120*b*, 120*c*, 120*d*, 120*e*, and 1200.

The pump output end connecting ports a3, b3, c3, d3, e3, and f3 may be arranged laterally, preferably horizontally at the same height. The pump input end connecting ports a2, b2, c2, d2, e2, and f2 may be positioned lower than the pump output end connecting ports a3, b3, c3, d3, e3, and f3. The pump input end connecting ports a2, b2, c2, d2, e2, and f2 may be arranged laterally, preferably horizontally at the same height.

The additive pumps 120*a*, 120*b*, 120*c*, 120*d*, 120*e*, and 120*f* may release an introduced additive to the output ends 122 through the input ends 121 connected to the pump input end connecting ports a2, b2, c2, d2, e2, and f2. The additive pumps 120*a*, 120*b*, 120*c*, 120*d*, 120*e*, and 120*f* may be peristaltic pumps each having a tube (not shown) that guides an additive to the output end 122 from the input end 121 and a rotor that forces the additive out from the tube by compressing the tube when rotated by the motor. The output ends 122 of the additive pumps 120*a*, 120*b*, 120*c*, 120*d*, 120*e*, and 120*f* are connected to the pump output end connecting ports a3, b3, c3, d3, e3, and f3 of the pump discharge paths 132*a*, 132*b*, 132*c*, 132*d*, 132*e*, and 132*f*.

Electrode sensors 150*a*, 150*b*, 150*c*, 150*d*, 150*e*, and 150*f* may be provided which are connected to the pump discharge paths 132*a*, 132*b*, 132*c*, 132*d*, 132*e*, and 132*f*. A plurality of electrode sensors 150*a*, 150*b*, 150*c*, 150*d*, 150*e*, and 150*f* may be provided corresponding to the plurality of pump discharge paths 132*a*, 132*b*, 132*c*, 132*d*, 132*e*, and 132*f*, and each of them may sense the additive guided through their corresponding pump discharge path 132*a*, 132*b*, 132*c*, 132*d*, 132*e*, and 132*f*.

Referring to FIG. 13, the electrode sensors 150*a*, 150*b*, 150*c*, 150*d*, 150*e*, and 150*f* output a signal when two electrodes separated from each other—one positive (+) and the other negative (−)—become conductive through a medium (a liquid additive in the exemplary embodiment). The electrode sensors 150*a*, 150*b*, 150*c*, 150*d*, 150*e*, and 150*f* each may have an inlet 151*a* and 151*b* connected to their corresponding pump discharge path 132*a*, 132*b*, 132*c*, 132*d*, 132*e*, and 132*f*, a chamber (not shown) with a pair of electrodes placed in it, through which the additive introduced through the inlet 151*a* and 151*b* passes, and an outlet 152*a* and 152*b* through which the additive passed through the chamber escapes.

The controller 3 may decide whether the additives are guided properly through the pump discharge paths 132*a*, 132*b*, 132*c*, 132*d*, 132*e*, and 132*f* based on the signal. That is, if any of the electrode sensors 150*a*, 150*b*, 150*c*, 150*d*, 150*e*, and 150*f* does not output a normal signal (e.g., a signal generated when the two electrodes become electrically conductive)—for example, in a case where an electrical connection between the two electrodes is released), it is decided that the additive in the additive cartridge 110*a*, 110*b*, 110*c*, 110*d*, 110*e*, and 110*f* connected by a flow channel to the corresponding pump discharge path 132*a*, 132*b*, 132*c*, 132*d*, 132*e*, and 132*f* is used up, and this may be indicated through the display 6 so that the user is easily aware of the depletion. Meanwhile, although, in the exemplary embodiment, two electrode sensors 150*a*, 150*b*, 150*c*, 150*d*, 150*e*, and 150*f* form a single assembly or module 150(1), 150(2), and 150(3), the present disclosure is not necessarily limited to this.

Figure 7:
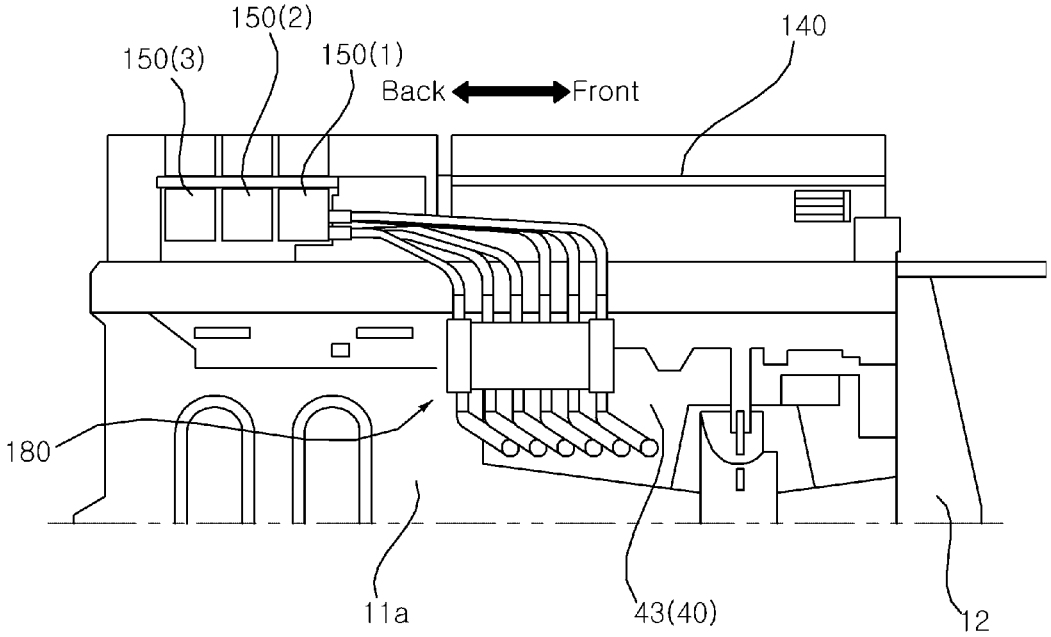
FIG. 7 is a view of the inside of the cabinet, which shows a structure in which a flow channel connector is mounted.
Figure 8:
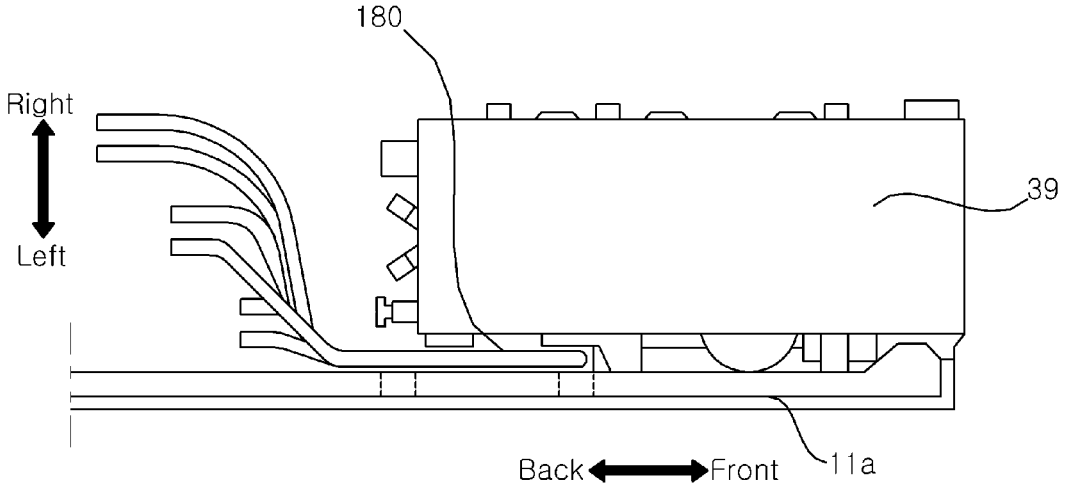
FIG. 8 is a top-down view of the inside of the cabinet, which shows where the flow channel connector is mounted.

Referring to FIGS. 7 and 11, a discharge guiding mechanism 180 is provided to guide the additives discharged from the pump discharge paths 132*a*, 132*b*, 132*c*, 132*d*, 132*e*, and 132*f* to the water supply guide flow channel 41 (see FIG. 9). The electrode sensors 150*a*, 150*b*, 150*c*, 150*d*, 150*e*, and 150*f* may connect their corresponding pump discharge paths 132*a*, 132*b*, 132*c*, 132*d*, 132*e*, and 132*f* and the discharge guiding mechanism 180 by flow channels.

Specifically, the discharge guiding mechanism 180 may include a plurality of additive intake pipes 181 (181*a*, 181*b*, 181*c*, 181*d*, 181*e*, and 1810, a plurality of additive discharge pipes 182 (182*a*, 182*b*, 182*c*, 182*d*, 182*e*, and 1820, and a flow channel connector 183. The additive intake pipes 181*a*, 181*b*, 181*c*, 181*d*, 181*e*, and 181*f* are connected to the electrode sensors 150*a*, 150*b*, 150*c*, 150*d*, 150*e*, and 150*f* by flow channels. The additive discharge pipes 182*a*, 182*b*, 182*c*, 182*d*, 182*e*, and 182*f* are connected to the water supply guide flow channel 41 of the drawer housing 40.

The flow channel connector 183 allows the additive intake pipes 181*a*, 181*b*, 181*c*, 181*d*, 181*e*, and 181*f* and the additive discharge pipes 182*a*, 182*b*, 182*c*, 182*d*, 182*e*, and 182*f* to communicate to each other, respectively. The flow channel connector 183 may be disposed on an outer side of the top cover housing 20. Preferably, the flow channel connector 183 is located between the drawer housing 40 and whichever of the left and rights sides of the main frame 11 within the cabinet 10 that is closer to the drawer housing 40. In the exemplary embodiment, the drawer housing 40 is placed more to the left within the cabinet 10, and therefore the flow channel connector 183 is located between the left side of the main frame 11 and the drawer housing 40.

The flow channel connector 183 may include a plurality of intake pipe connecting ports 183*a*1, 183*b*1, 183*c*1, 183*d*1, 183*e*1, and 183*f*1, a plurality of discharge pipe connecting ports 183*a*2, 183*b*2, 183*c*2, 183*d*2, 183*e*2, and 183*f*2, and a plurality of port connecting paths (not shown) that the intake pipe connecting ports 183*a*1, 183*b*1, 183*c*1, 183*d*1, 183*e*1, and 183*f*1 and the discharge pipe connecting ports 183*a*2, 183*b*2, 183*c*2, 183*d*2, 183*e*2, and 183*f*2, respectively. The intake pipe connecting ports 183*a*1, 183*b*1, 183*c*1, 183*d*1, 183*e*1, and 183*f*1, the discharge pipe connecting ports 183*a*2, 183*b*2, 183*c*2, 183*d*2, 183*e*2, and 183*f*2, and the port connecting paths may be formed integrally with the flow channel connector 183. The intake pipe connecting ports 183*a*1, 183*b*1, 183*c*1, 183*d*1, 183*e*1, and 183*f*1 may be positioned higher than the discharge pipe connecting ports 183*a*2, 183*b*2, 183*c*2, 183*d*2, 183*e*2, and 183*f*2.

Referring to FIG. 9, the drawer housing 40 may have a plurality of additive discharge holes h1, h2, h3, h4, h5, and h6 that are respectively connected to outlets of the additive discharge pipes 182*a*, 182*b*, 182*c*, 182*d*, 182*e*, and 182*f*. The additive discharge holes h1, h2, h3, h4, h5, and h6 may allow the additives discharged through the outlets of the additive discharge pipes 182*a*, 182*b*, 182*c*, 182*d*, 182*e*, and 182*f* to be released to the water supply guide flow channel 41.

The drawer housing 40 is for guiding the water released from the drawer 38 to the water supply bellows 35, and may include a water supply guiding surface 42 which constitutes at least part of the water supply guide flow channel 41 and faces the topside. The additive discharge holes h1, h2, h3, h4, h5, and h6 may be positioned higher than the water supply guiding surface 42 so that the additives discharged from the additive discharge holes h1, h2, h3, h4, h5, and h6 are discharged onto the water supply guiding surface 42.

More specifically, the drawer housing 40 may include a left side portion 43 and a right side portion 44 which extend upward from the left and right sides of the water supply guiding surface 42. In this case, the additive discharge holes h1, h2, h3, h4, h5, and h6 may be formed on at least one of the left and right portions 43 and 44.

It will be apparent that, although the exemplary embodiment has been shown and described above, the present disclosure is not limited to the above-described specific embodiment, and various modifications and variations can be made by those skilled in the art without departing from the gist of the appended claims. Thus, it is intended that the modifications and variations should not be understood independently of the technical spirit or prospect of the present disclosure.

What is claimed is:

1. A washing machine comprising:

a cabinet with an open top;

a tub disposed within the cabinet to contain water;

a drum rotatably provided within the tub to hold laundry;

a drawer disposed within the cabinet to hold detergent;

a drawer housing disposed inside the cabinet, where the drawer is received in such a way as to be pulled out, and which has a water supply guide flow channel for allowing water passed through the drawer to be poured into the tub when water is supplied;

a top cover housing covering the open top of the cabinet and defining a predetermined receiving space above the cabinet;

a detergent mixer disposed in the receiving space; and a discharge guiding apparatus including a plurality of flow channels connected to the water supply guide flow channel of the drawer housing, the detergent mixer comprising:

a plurality of additive cartridges that individually contain liquid additives;

a plurality of additive pumps corresponding to the plurality of additive cartridges; and a flow channel box comprising a plurality of pump intake paths that guide the additives discharged from the additive cartridges to the additive pumps, respectively, and a plurality of pump discharge paths that guide the additives discharged from the additive pumps, respectively, wherein the discharge guiding apparatus guides the additives discharged from the pump discharge paths to the water supply guide flow channel.

2. The washing machine of claim 1, wherein the top cover housing is slidably attached to an upper end of the cabinet.

3. The washing machine of claim 1, wherein each of the pump intake paths comprises:

a cartridge connecting port connected by a flow channel to an outlet of one of the additive cartridges, and a pump input end connecting port connected to an inlet of one of the additive pumps, and wherein each of the pump discharge paths comprises a pump output end connecting port connected to an outlet of one of the additive pumps.

4. The washing machine of claim 3, wherein the flow channel box is located between the additive cartridges and the additive pumps, and wherein the cartridge connecting ports and the pump input end connecting ports on the pump intake paths and the pump output end connecting ports on the pump discharge paths are provided on an outer surface of the flow channel box, the cartridge connecting ports are provided on a front of the flow channel box facing the additive cartridges, and the pump input end connecting ports and the pump output end connecting ports face the additive pumps.

5. The washing machine of claim 4, wherein the pump output end connecting ports are positioned higher than the pump input end connecting ports.

6. The washing machine of claim 1, further comprising a plurality of electrode sensors corresponding to the plurality of pump discharge paths, each of which senses the additive guided through the corresponding pump discharge path.

7. The washing machine of claim 6, wherein the electrode sensors connect the corresponding pump discharge paths and the discharge guiding apparatus by the plurality of flow channels.

8. The washing machine of claim 7, wherein the discharge guiding apparatus comprises:

a plurality of additive intake pipes connected to the electrode sensors by flow channels;

a plurality of additive discharge pipes connected to the water supply guide flow channel of the drawer housing by flow channels; and a flow channel connector fixed to the cabinet on an outer side of the top cover housing, which allows the additive intake pipes and the additive discharge pipes to communicate to each other, respectively.

9. The washing machine of claim 8, wherein the flow channel connector comprises:

a plurality of intake pipe connecting ports where the plurality of electrode sensors are respectively connected;

a plurality of discharge pipe connecting ports where the plurality of additive discharge pipes are respectively connected; and a plurality of port connecting paths that connect the intake pipe connecting ports and the discharge pipe connecting ports, respectively, wherein the intake pipe connecting ports, the discharge pipe connecting ports, and the port connecting paths are formed integrally with the flow channel connector.

10. The washing machine of claim 9, wherein the intake pipe connecting ports are positioned higher than the discharge pipe connecting ports.

11. The washing machine of claim 9, wherein the drawer housing has a plurality of additive discharge holes that are respectively connected to outlets of the additive discharge pipes to allow the additives discharged through the outlets of the additive discharge pipes to be released to the water supply guide flow channel.

12. The washing machine of claim 1, wherein the detergent mixer further comprises a cartridge housing disposed within the top cover housing, which defines a space inside where the additive cartridges are received.

13. The washing machine of claim 12, wherein the top cover housing comprises:

a housing body with an open front, inside which the receiving space is defined; and a housing cover for opening and closing the open front of the housing body, wherein the detergent mixer further comprises a cartridge housing disposed within the top cover housing, which holds the additive cartridges, with an open front facing the front of the housing body so that the additive cartridges are pushed in or pulled out.

14. The washing machine of claim 1, wherein the detergent mixer further comprises a plurality of electrode sensors that sense the detergents discharged from the plurality of pump discharge paths, respectively.

15. The washing machine of claim 14, wherein the electrode sensors each have a sensor inlet that are respectively connected to the pump discharge paths, a chamber with a pair of electrodes placed therein, through which the additive introduced through the sensor inlet passes, and a sensor outlet through which the additive passed through the chamber escapes, and wherein the detergent mixer further comprises a plurality of additive intake pipes for guiding the additives discharged from the sensor outlets of the plurality of electrode sensors, respectively.

* * * * *